United States Patent [19]

Morris

[11] 4,204,511

[45] May 27, 1980

[54] COMBINATION IGNITION SWITCH AND FUEL PRIMING SYSTEM

[75] Inventor: Richard L. Morris, Galesburg, Ill.

[73] Assignee: Outboard Marine Corporation, Waukegan, Ill.

[21] Appl. No.: 4,653

[22] Filed: Jan. 19, 1979

[51] Int. Cl.[2] ..... F02M 1/16; F02N 17/00

[52] U.S. Cl. ..... 123/187.5 R; 123/139 AJ; 123/179 G

[58] Field of Search ..... 123/187.5 R, 187.5 P, 123/139 A, 139 AJ, 73 R, 179 G, 179 B, 180 E; 417/383

[56] References Cited

U.S. PATENT DOCUMENTS

| | | | |
|---|---|---|---|
| 1,404,152 | 1/1922 | Kettering | 123/187.5 R |
| 1,466,828 | 9/1923 | Hanley | 123/187.5 R |
| 1,624,139 | 4/1927 | Kettering | 123/187.5 R |
| 2,592,945 | 4/1952 | Odell | 123/187.5 R |
| 2,918,913 | 12/1959 | Guiot | 123/187.5 R |
| 3,451,383 | 6/1969 | Nelson | 123/187.5 R |
| 3,978,839 | 9/1976 | DuBois et al. | 123/187.5 R |

*Primary Examiner*—Charles J. Myhre
*Assistant Examiner*—P. S. Lall
*Attorney, Agent, or Firm*—Michael, Best & Friedrich

[57] ABSTRACT

An engine comprises a combustion chamber and a fuel delivery system which communicates with the combustion chamber and is adapted for connection to a fuel source. The fuel delivery system is operative for pumping fuel into the combustion chamber, and an ignition system is provided for igniting fuel in the combustion chamber. An ignition switch is operatively connected with the fuel ignition system and is operatively movable between an off position for preventing operation of the fuel ignition system and an on position for permitting operation of the fuel ignition system. A priming mechanism operatively connects the fuel delivery system with the ignition switch for operating the fuel delivery system to pump fuel into the combustion chamber simultaneously with movement of the ignition switch between the off position and the on position.

19 Claims, 5 Drawing Figures

COMBINATION IGNITION SWITCH AND FUEL PRIMING SYSTEM

BACKGROUND OF THE INVENTION

1. Field of the Invention

The invention relates to internal combustion engines and, more particularly, to primer systems for internal combustion engines.

II. Description of the Prior Art

Attention is directed to the following U.S. Pat. Nos. and patent application Ser. Nos.

| | | |
|---|---|---|
| Wynne et al | 2,271,383 | January 27, 1942 |
| Howel | 2,945,483 | July 19, 1960 |
| Puttfarcken | 3,273,628 | September 20, 1966 |
| Nelson | 3,451,383 | June 24, 1969 |
| Schlagmuller et al | 3,614,945 | October 26, 1971 |
| DuBois et al | 3,978,839 | September 7, 1976 |
| Turner | Appln. S.N. 723,818 | Filed September 16, 1976 |
| McChesney et al | Appln. S.N. 835,417 | Filed September 21, 1977 |

Engines which include electrically actuated ignition circuits having ignition switches for turning the ignition circuits on and off are known. Engines which include priming systems which pump a quantity of priming fuel into the combustion chambers to facilitate ignition during starting operations are also known. However, none of the above prior art discloses a means for interconnecting the operation of the ignition switch with the operation of the fuel priming system.

SUMMARY OF THE INVENTION

The invention provides an engine comprising a combustion chamber and fuel delivery means which communicates with the combustion chamber and is adapted for connection to a fuel source. The fuel delivery means is operative for pumping fuel into the combustion chamber, and the engine includes means for igniting fuel in the combustion chamber. Switch means is operatively connected with the fuel ignition means and is operatively movable between an off position for preventing operation of the fuel ignition means and an on position for permitting operation of the fuel ignition means. Means which is operatively connected with the fuel delivery means and the switch means is provided for operating the fuel delivery means to pump fuel into the combustion chamber simultaneously with the movement of the switch means between the off position and the on position.

In accordance with one embodiment of the invention, the fuel delivery means includes fuel conduit means communicating with the fuel source for introducing fuel into the combustion chamber, and a fuel pump communicating with the fuel conduit means and having a diaphragm defining a pulse chamber and a fuel chamber. By virtue of this construction, a pressure pulse communicated to the pulse chamber will oscillate the diaphragm and pump fuel from the fuel chamber toward the combustion chamber. In this embodiment, the means for operating the fuel delivery means includes means for generating a pressure pulse in response to movement of the switch means between the off position and the on position and pulse conduit means operatively connecting the pulse chamber with the means for generating a pressure pulse.

In accordance with one embodiment of the invention, the means for creating a pressure pulse includes air pump means including an air bladder confining a finite amount of air and communicating with the pulse conduit means and plunger means operatively connected with the air bladder for expelling air from the air bladder in response to movement of the switch means between the on position and the off position. More particularly, the plunger means is movable between a first position disengaged from the air bladder and a second position engaged with the air bladder for expelling air from the air bladder, and the means for operating the fuel delivery means includes cam means operatively connected with the switch means for moving the plunger means between the disengaged position and the engaged position simultaneously with movement of the switch means between the on position and the off position.

In accordance with one embodiment of the invention, the cam means includes means for disposing the plunger means in the disengaged position when the switch means is in the off position and in the on position and for disposing the plunger means in the engaged position when the switch means is located intermediate the off position and the on position.

In accordance with one embodiment of the invention, the engine further includes means for biasing the plunger means toward the disengaged position when the switch means is in the off position and in the on position, and the cam means includes means for moving the plunger means from the disengaged position to the engaged position against the action of the biasing means during movement of the switch means between the off position and the on position.

In accordance with one embodiment of the invention, the engine further includes means for locking the plunger means in the disengaged position when the switch means is in the off position.

In accordance with one embodiment of the invention, the engine further includes means for permitting manual operation of the plunger means between the disengaged position and the engaged position when the switch means is in the on position.

In accordance with one embodiment of the invention, the fuel ignition means includes a source of electrical energy, a spark plug communicating with the combustion chamber, and circuit means for conducting electrical energy from the source to the spark plug for operating the spark plug. In this embodiment, the switch means is electrically connected in the circuit means for permitting the flow of electrical energy in the circuit means when the switch means is in the on position and for interrupting the flow of electrical energy in the circuit means when the switch means is in the off position. Also in this embodiment, the switch means includes a housing, a switch member rotatably mounted on the housing for movement between a first rotational position and a second rotational position, and means for disposing the switch means in the off position when the switch member is in the first rotational position and for disposing the switch means in the on position when the switch member is in the second rotational position. The means for operating the fuel delivery means is mounted on the housing and operatively connected with the switch member for operation simultaneously with movement of the switch member between the first rotational position and the second rotational position.

One of the principal features of the invention is provision of a fuel priming system to facilitate starting of an engine, which priming system includes means for selectively delivering a quantity of primer fuel into the combustion chamber simultaneously with operation of the ignition switch between its off position and its on position.

Another of the principal features of the invention is the provision of a fuel priming system for an engine which priming system is automatically operable in response to operation of the ignition switch as well as manually operable when the ignition switch is on.

Other features and advantages of the embodiments of the invention will become apparent upon reviewing the following general description, the drawings and the appended claims.

Figure 1:
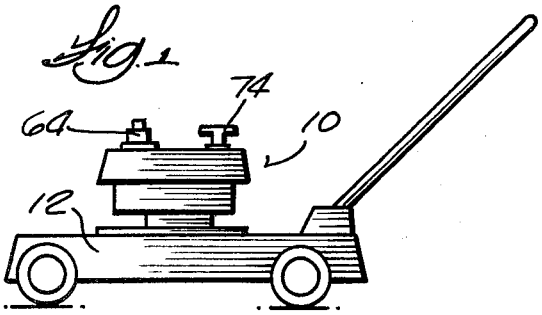
FIG. 1 is a partially diagrammatic view of an internal combustion engine which embodies various of the features of the invention and which is shown as part of a powered rotary lawn mower.

Before explaining one embodiment of the invention in detail, it is to be understood that the invention is not limited in its application to the details of construction and the arrangements of the components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Shown in FIG. 1 is an engine 10 which embodies various of the features of the invention. Although the invention is broadly applicable for use in any power driven device, in the illustrated embodiment, the engine 10 is mounted on a lawn mower 12 and is operatively connected therewith to drive a rotary cutting blade assembly (not shown).

Figure 5:
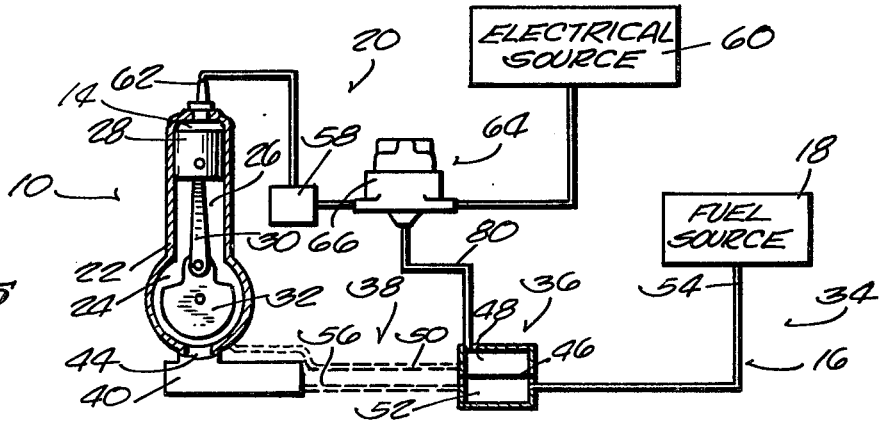
FIG. 5 is a fragmentary and partially diagrammatic view of the engine shown in FIG. 1.

As shown in FIG. 5, the engine 10 is an internal combustion engine which includes a combustion chamber 14 and fuel delivery means 16 which is adapted for connection to a fuel source 18 and which communicates with the combustion chamber 14 for pumping fuel from the fuel source 18 into the combustion chamber 14. Means 20 is provided for igniting the fuel which is delivered to the combustion chamber 14 to thereby power the engine 10.

While various engine constructions can be used, the engine 10 includes a block member 22 defining a crank case 24 and a cylinder 26 extending from the crank case 24. A piston 28 is mounted for reciprocative movement inside the cylinder 26 in response to fuel ignition, and is connected by a connecting rod 30 to a crank shaft 32 which is rotatably mounted in the crank case 24. Rotation of the crank shaft 32 in response to piston reciprocation drives the cutting blade assembly or other power driven mechanism.

As is also shown in FIG. 5, the fuel delivery means 16 includes a fuel conduit 34 which conducts fuel from the source 18 to the combustion chamber 14, and fuel pumping means 36 which communicates with the fuel conduit 34 for pumping fuel through the fuel conduit 34 and into the combustion chamber 14. While various constructions can be used, in the illustrated embodiment, a conventional aspirated diaphragm-type carburetor 38 (shown diagrammatically in FIG. 5) is provided which has an air induction passage 40 and an air-fuel induction port 44 which is connected in communication with the crank case 24. The carburetor 38 includes a fuel pump 36 which includes a diaphragm 46 which can be oscillated in response to a pressure pulse and which thereby defines a pulse chamber 48 communicating with the crank case 24 through a suitable pulse conduit 50 and a fuel chamber 52 communicating with an inlet conduit 54 emanating from the fuel source 18 and with an outlet conduit 56 communicating with the air induction passage 40. A diaphragm-type fuel pump separate from the carburetor 38 can also be employed.

By virtue of this construction, pressure pulses occasioned by piston reciprocation will be communicated to the pulse chamber 48 through the pulse conduit 50 and will consequently oscillate the diaphragm 46, and fuel is thereby pumped from the fuel chamber 52 into the air induction passage 40 through the outlet conduit 56 and, ultimately, into the combustion chamber 14 for ignition.

In the illustrated embodiment (and still referring to FIG. 5), the fuel ignition means 20 is electrically actuated. More particularly, electrical energy is conducted by an ignition circuit 58 of conventional construction from a source 60, such as an alternator, to a spark plug 62 which protrudes into the combustion chamber 14. An ignition switch 64 is mounted on the lawn mower 12 (see FIG. 1) and is electrically connected in the ignition circuit 58 for operative movement between an off position for interrupting the flow of electrical energy in the ignition circuit 58, thereby preventing fuel ignition and thus engine operation, and an on position for permitting the flow of electrical energy in the ignition circuit 58 to thereby operate the spark plug 62 and permit engine operation.

Figure 2:
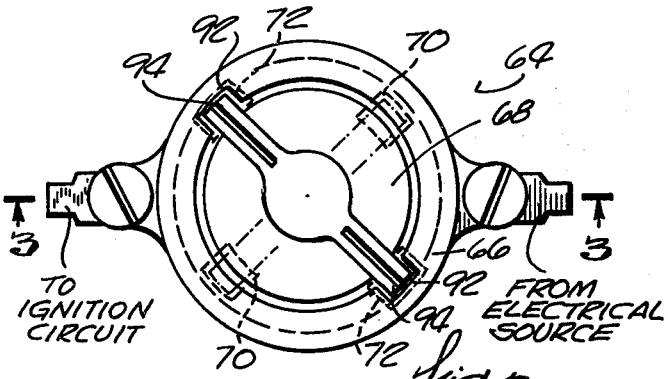
FIG. 2 is a top view of the combined ignition switch and engine primer which is incorporated in the engine shown in FIG. 1.
Figure 4:
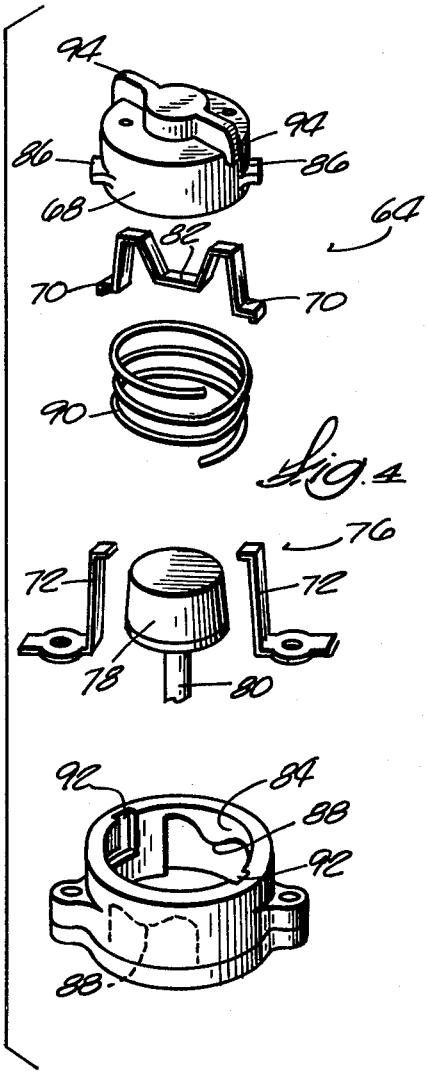
FIG. 4 is an exploded view of the combined ignition switch and engine primer shown in FIG. 1.
Figure 3:
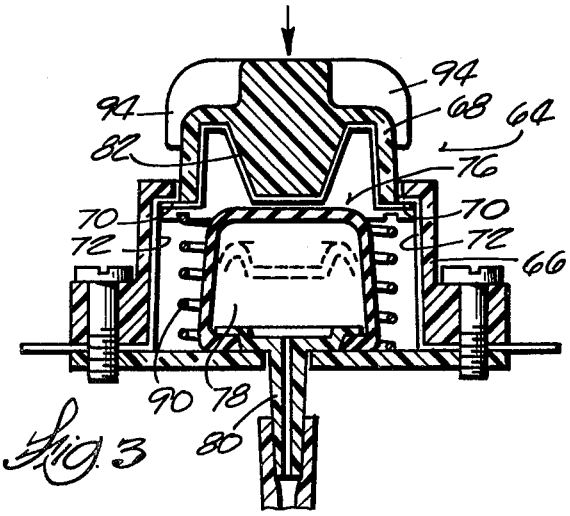
FIG. 3 is a sectional side view of the combined ignition switch and engine primer taken generally along line 3—3 of FIG. 2.

Referring now to FIGS. 2, 3, and 4, the ignition switch 64 includes a housing 66 and a cap member 68 which is rotatably mounted on the housing 66 for movement between a first rotational position (shown in phantom lines in FIG. 2) and a second rotational position (shown in solid lines in FIG. 2). As is best seen in FIG. 4, a pair of switch leads 70 is carried by the cap member 68 for common rotation, and a corresponding pair of switch contacts 72 is secured in the housing 66 and electrically interposed in the ignition circuit 58 between the source 60 and the spark plug 62.

As can be best seen in FIG. 2, when the cap member 68 is in its first rotational position, the switch leads 70 are spaced from the switch contacts 72, thereby defining an electrically open circuit which interrupts the flow of electrical energy between the source 60 and the spark plug 62 and which corresponds to the heretofore described "off" position. When the cap member 68 is subsequently moved from its first rotational position to its second rotational position, the switch leads 70 engage the switch contacts 72 and thereby define an electrically closed circuit which permits the passage of electrical energy through the ignition switch 64 and which corresponds to the heretofore described "on" position.

The engine 10 includes a conventional starting mechanism (not shown) which, in the illustrated embodiment (see FIG. 1), is mechanically actuated by means of a pull rope 74. Alternately, the starter mechanism may be electrically actuated, such as by an electric motor (also not shown). In either case, before starting the engine 10, it is first necessary to move the ignition switch 64 from its off position to its on position so that electrical energy may flow through the ignition circuit 58 to permit fuel combustion necessary to initiate and sustain engine operation.

When the engine 10 is cold or has been inoperative for some time, it is often necessary to manually or electrically crank the engine 10 with the starter mechanism for an extended period of time before a sufficient combustible quantity of fuel is delivered to the combustion chamber 14 in response to pressure variations which occur in the crank case 24 and which are communicated to the pulse chamber 46 by conduit 50.

In order to facilitate the delivery of a combustible amount of fuel to the combustion chamber 14 without extensive cranking, the pulse chamber 48 of the fuel pump 36 is operatively connected with the ignition switch 64 so that movement of the ignition switch 64 between its off position and its on position simultaneously oscillates the diaphragm 46. More particularly, means 76 is provided for generating a pressure pulse in response to movement of the ignition switch 64 between its off position and its on position, which pressure pulse is communicated directly to the pulse chamber 48 of the fuel pump 36.

While various constructions can be used, in the illustrated embodiment, the means 76 for generating a pressure pulse includes an air pump which is defined by a resilient air bladder 78 or bulb which is mounted in the switch housing 66. The air bladder 78 confines a finite volume of air, and a conduit 80 (see FIG. 5) connects the air bladder directly with the pulse chamber 48 of the fuel pump 36. A plunger 82 is mounted on the cap member 68 and is operable to depress the air bladder 78 and thus expel air from the air bladder 78 into the conduit 80 and ultimately into the pulse chamber 48.

More particularly, the cap member 68 is displaceable vertically along its axis of rotation. The plunger 82 is defined by a shoulder formed intermediate the switch leads 70, and vertical displacement of the cap member 68 will move the plunger 82 between a first position disengaged from the air bladder (as shown in solid line in FIG. 3) and a second position engaged with the air bladder (as shown in phantom lines in FIG. 3). As heretofore described, engagement of the plunger 82 deforms the resilient air bladder 78 and expels a pulse of air through the conduit 80 into the pulse chamber 48 to oscillate the diaphragm 46. A finite amount of fuel is thereby pumped out of the fuel chamber 52 and into the induction passage 40 for ultimate delivery into the combustion chamber 14. The amount of fuel which would otherwise be delivered during cranking is thereby increased, and the engine 10 is thereby primed subsequent to starting.

By virtue of the construction just described (see FIG. 3), operation of the plunger 82 also moves the switch leads 70 vertically relative to the switch contacts 72. Thus, should the cap member 68 be disposed in its second rotational, or switch on, position, operation of the plunger 82 between its disengaged and engaged positions will momentarily break the electrical connection between the switch leads 70 and the switch contacts 72. However, this momentary interruption of the flow of electrical energy in the ignition circuit 58 during priming does not interfere with starting the engine.

While the ignition switch 64 may be constructed so that the cap member 68 may be manually depressed during movement between its first rotational position and second rotational position to thereby prime the engine, in the illustrated embodiment (see FIG. 4), cam means 84 is provided so that movement of the cap member 68 between its first rotational position and its second rotational position will simultaneously and automatically displace the plunger shoulder 82 between its disengaged position and its engaged position. As is best shown in FIG. 4, and realizing that various constructions are possible, an oppositely spaced pair of tabs 86 projects outwardly of the cap member 68. The interior portion of the switch housing 66 includes a corresponding pair of oppositely spaced cut out portions which define generally undulating or sinusoidal cam surfaces 88. The tabs 86 engage and follow along the undulating cam surfaces 88 as the cap member 68 is rotated between its first rotational, or switch off, position and its second rotational, or switch on, position.

While various constructions are possible, for example, the use of a tongue-and-groove cam follower, in the illustrated embodiment, a spring 90 biases the plunger 82 toward its disengaged position from the air bladder 78. The cam surfaces 88 are symmetrically formed such that, when the cap member 68 is in either its first rotational position or in its second rotational position, the spring 90 maintains the plunger 82 in its disengaged position. This also insures that when the cap member 68 is in its second rotational, or switch on, position, electrical contact between the switch leads 70 and switch contacts 72 is normally made. However, when the cap member 68 is located intermediate its first rotational position and its second rotational position, the plunger 82 is located, against the action of the spring 90, in its engaged position with the air bladder 78.

Thus, as can be seen, movement of the cap member 68 between its first rotational position and its second rotational position, thereby turning the ignition switch on, causes the plunger 82 to engage the air bladder 78 a single time which thus creates a single pulse of pressure which is delivered to the pulse chamber 48 of the fuel pump 36. Likewise, when the cap member 68 is moved from its second rotational position back to its first rotational position, thereby turning the ignition switch off and terminating engine operation, the plunger 82 once again engages the air bladder a single time, again creating a single pulse of pressure which is delivered to the pulse chamber 48 and which injects fuel into the combustion chamber 14 to prevent the engine 10 from dying in a "too lean" condition.

In order that the operator may manually prime the engine 10 during cranking of the engine, the interior portion of the housing 66 includes an aligned pair of generally vertical slots 92, and the cap member 68 includes a corresponding pair of outwardly projecting lugs 94 which align with the slots 92 when the cap member 68 is in its second rotational position (see FIG. 2). Thus, when the cap member 68 is in its second rotational, or switch on, position, the plunger 82 may be manually operated, or pumped, between its normally biased disengaged position and its engaged position to deliver a series of pressure pulses to the pulse chamber 48 should additional priming fuel be desired. As before discussed, the momentary interruption of the ignition circuit 58 occasioned by separation of the switch leads 70 and switch contacts 72 during pumping does not affect engine starting. However, when the switch cap is in its first rotational, or switch off, position, the lugs 94 are spaced apart from the slots 92, and the extent of manual depression of the cap member 68 will be limited by virtue of the contact between the lugs 94 against the upper body portion 96 of the switch housing 66 (see FIG. 3) so that engagement of the plunger 82 with the air bladder 78 is prevented. Operation of the air bladder 78 is thereby prevented when the ignition switch is in the off position, which thereby minimizes the chances of flooding the engine 10 prior to initiating starting operation.

Various of the features of the invention are set forth in the following claims.

What is claimed is:

1. An engine comprising a combustion chamber, fuel delivery means communicating with said combustion chamber and adapted for connection to a fuel source, said fuel delivery means being operative for pumping fuel into said combustion chamber, means for igniting fuel in said combustion chamber, switch means operatively connected with said fuel ignition means and operatively movable between an off position for preventing operation of said fuel ignition means and an on position for permitting operation of said fuel ignition means, and means operatively connected with said fuel delivery means and said switch means for operating said fuel delivery means to pump fuel into said combustion chamber simultaneously with movement of said switch means between said off position and said on position.

2. An engine according to claim 1 wherein said fuel delivery means includes fuel conduit means communicating with the fuel source for introducing fuel into said combustion chamber, and fuel pumping means communicating with said fuel conduit means for pumping fuel through said fuel conduit means in response to a pressure pulse, and wherein said means for operating said fuel delivery means includes means for generating a pressure pulse in response to movement of said switch means between said off position and said on position, and pulse conduit means operatively connecting said fuel pumping means with said means for generating a pressure pulse.

3. An engine according to claim 2 wherein said fuel pumping means includes a diaphragm defining a pulse chamber communicating with said pulse conduit means and a fuel chamber communicating with said fuel conduit means.

4. An engine according to claim 2 wherein said means for creating a pressure pulse includes air pump means operative for creating a pressure pulse in response to movement of said switch means between said on position and said off position.

5. An engine according to claim 4 wherein said air pump means includes an air bladder confining a finite amount of air and communicating with said pulse conduit means, and plunger means operatively connected with said air bladder for expelling air from said air bladder.

6. An engine according to claim 5 wherein said plunger means is movable between a first position disengaged from said air bladder and a second position engaged with said air bladder for expelling air from said air bladder, and wherein said means for operating said fuel delivery means includes cam means operatively connected with said switch means for moving said plunger means between said disengaged position and said engaged position simultaneously with movement of said switch means between said on position and said off position.

7. An engine according to claim 6 wherein said cam means includes means for disposing said plunger means in said disengaged position when said switch means is in said off position and in said on position and for disposing said plunger means in said engaged position when said switch means is located intermediate said off position and said on position.

8. An engine according to claim 6 and further including means for biasing said plunger means toward said disengaged position when said switch means is in said off position and in said on position, and wherein said cam means includes means for moving said plunger means from said disengaged position to said engaged position against the action of said biasing means during movement of said switch means between said off position and said on position.

9. An engine according to claim 6 and further including means for locking said plunger means in said disengaged position when said switch means is in said off position.

10. An engine according to claim 6 and further including means for permitting manual operation of said plunger means between said disengaged position and said engaged position when said switch means is in said on position.

11. An engine according to claim 1 wherein said fuel ignition means includes a source of electrical energy, a spark plug communicating with said combustion chamber, and circuit means for conducting electrical energy from said source to said spark plug for operating said spark plug, and wherein said switch means is electrically connected in said circuit means for permitting the flow of electrical energy in said circuit means when said switch means is in said on position and for interrupting the flow of electrical energy in said circuit means when said switch means is in said off position.

12. An engine according to claim 1 wherein said switch means includes a housing, a switch member rotatably mounted on said housing for movement between a first rotational position and a second rotational position, and means for disposing said switch means in said off position when said switch member is in said first rotational position and for disposing said switch means in said on position when said switch means is in said second rotational position.

13. An engine according to claim 12 wherein said means for operating said fuel delivery means is mounted on said housing and operatively connected with said switch member for operation simultaneously with movement of said switch member between said first rotational position and said second rotational position.

14. An engine comprising a combustion chamber, fuel conduit means communicating with said combustion chamber and adapted for connection to a fuel source, fuel pumping means communicating with said fuel conduit means for pumping fuel through said conduit means in response to a pressure pulse, a source of electrical energy, a spark plug communicating with said combustion chamber for igniting fuel in said combustion chamber, circuit means for conducting electrical energy from said source to said spark plug for operating said spark plug, switch means electrically connected in said circuit means and operatively movable between an off position for interrupting the flow of electrical energy in said circuit means and an on position for permitting the flow of electrical energy in said circuit means, means for generating a pressure pulse in response to movement of said switch means between said off position and said on position, and pulse conduit means operatively connecting said fuel pumping means with said means for generating a pressure pulse.

15. An engine according to claim 14 wherein said fuel pumping means includes a diaphragm defining a pulse chamber communicating with said pulse conduit means and a fuel chamber communicating with said fuel conduit means, wherein said means for creating a pressure plate includes an air bladder confining a finite amount of air and communicating with said pulse conduit means, a plunger movable between a first position disengaged from said air bladder and a second position engaged with said air bladder for expelling air from said air bladder, and cam means operatively connected with said switch means and said plunger for moving said plunger between said disengaged position and said engaged position simultaneously with movement of said switch means between said on position and said off position.

16. An engine according to claim 15 wherein said switch means includes a housing, a switch member rotatably mounted on said housing for movement between a first rotational position and a second rotational position, means for disposing said switch means in said off position when said switch member is in said first rotational position and for disposing said switch means in said on position when said switch member is in said second rotational position, wherein said air bladder is mounted on said housing, wherein said plunger is mounted on said switch member, and wherein said cam means includes means for disposing said plunger in said disengaged position when said switch member is in said first rotational position and said second rotational position and for disposing said plunger in said engaged position when said switch member is located intermediate said first rotational position and said second rotational position.

17. An engine according to claim 16 and further including means for biasing said plunger toward said disengaged position when said switch member is in said first rotational position and said second rotational position, and wherein said cam means includes means for moving said plunger from said disengaged position to said engaged position against the action of said biasing means during movement of said switch member between said first rotational position and said second rotational position.

18. An engine according to claim 17 and further including means for locking said plunger in said disengaged position when said switch member is in said first rotational position.

19. An engine according to claim 18 and further including means for permitting manual operation of said plunger between said disengaged position and said engaged position when said switch member is in said second rotational position.

* * * * *